US005127204A

United States Patent [19]

Braun

[11] Patent Number: 5,127,204

[45] Date of Patent: Jul. 7, 1992

[54] PROTECTIVE LATH FOR MAKING A PLASTER JOINT WHEN PLASTERING A WALL

[76] Inventor: August Braun, Theresienstrasse 36, D-6653 Blieskastel, Fed. Rep. of Germany

[21] Appl. No.: 466,458

[22] PCT Filed: Nov. 25, 1988

[86] PCT No.: PCT/EP88/01074

§ 371 Date: Jul. 24, 1990

§ 102(e) Date: Jul. 24, 1990

[87] PCT Pub. No.: WO89/04897

PCT Pub. Date: Jun. 1, 1989

[30] Foreign Application Priority Data

Nov. 25, 1987 [DE] Fed. Rep. of Germany ..... 3739912

[51] Int. Cl.[5] ..... E04B 2/08

[52] U.S. Cl. ..... 52/417; 52/98; 52/288; 52/454

[58] Field of Search ..... 52/417, 419, 420, 421, 52/98, 222, 454, 288

[56] References Cited

U.S. PATENT DOCUMENTS

| | | | |
|---|---|---|---|
| 3,290,838 | 12/1966 | Van Bael | 52/98 |
| 3,765,138 | 10/1973 | Bentle | 52/288 |
| 4,672,787 | 6/1987 | Murphy | 52/417 |
| 4,912,899 | 4/1990 | Plasker et al. | 52/417 |

FOREIGN PATENT DOCUMENTS

| | | |
|---|---|---|
| 1182410 | 11/1964 | Fed. Rep. of Germany . |
| 1906455 | 8/1970 | Fed. Rep. of Germany . |
| 8225357 | 4/1983 | Fed. Rep. of Germany . |
| 8611867 | 8/1986 | Fed. Rep. of Germany . |
| 8702045 | 8/1987 | Fed. Rep. of Germany . |

*Primary Examiner*—David A. Scherbel
*Assistant Examiner*—Kien Nguyen
*Attorney, Agent, or Firm*—Dickstein, Shapiro & Morin

[57] ABSTRACT

A protective lath for protection againt dirt and damage during wall plastering and against penetration of moisture at the joint to building components of different material, such as wood, plastics or metal, in particular to window and door frames or rafter ends, on which the plaster abuts; the protective lath is made of hard synthetic resin injected by an extruder into a continuous flow mold and carries a strip for adhering it to such a building component as well as a lateral protective tab which can be broken off by hand via a notch-type incision; a top part also made of hard synthetic resin is pressed onto a bottom part of the protective lath which carries said adhesive strip, with a reinforcing fabric, e.g. of synthetic resin coated silk glass, that extends as far as possible into the plaster layer, being interposed between said parts, and the free end of the top part being resiliently latched in an undercut nose piece of a side wall of the bottom part.

17 Claims, 3 Drawing Sheets

PROTECTIVE LATH FOR MAKING A PLASTER JOINT WHEN PLASTERING A WALL

Figure 1:
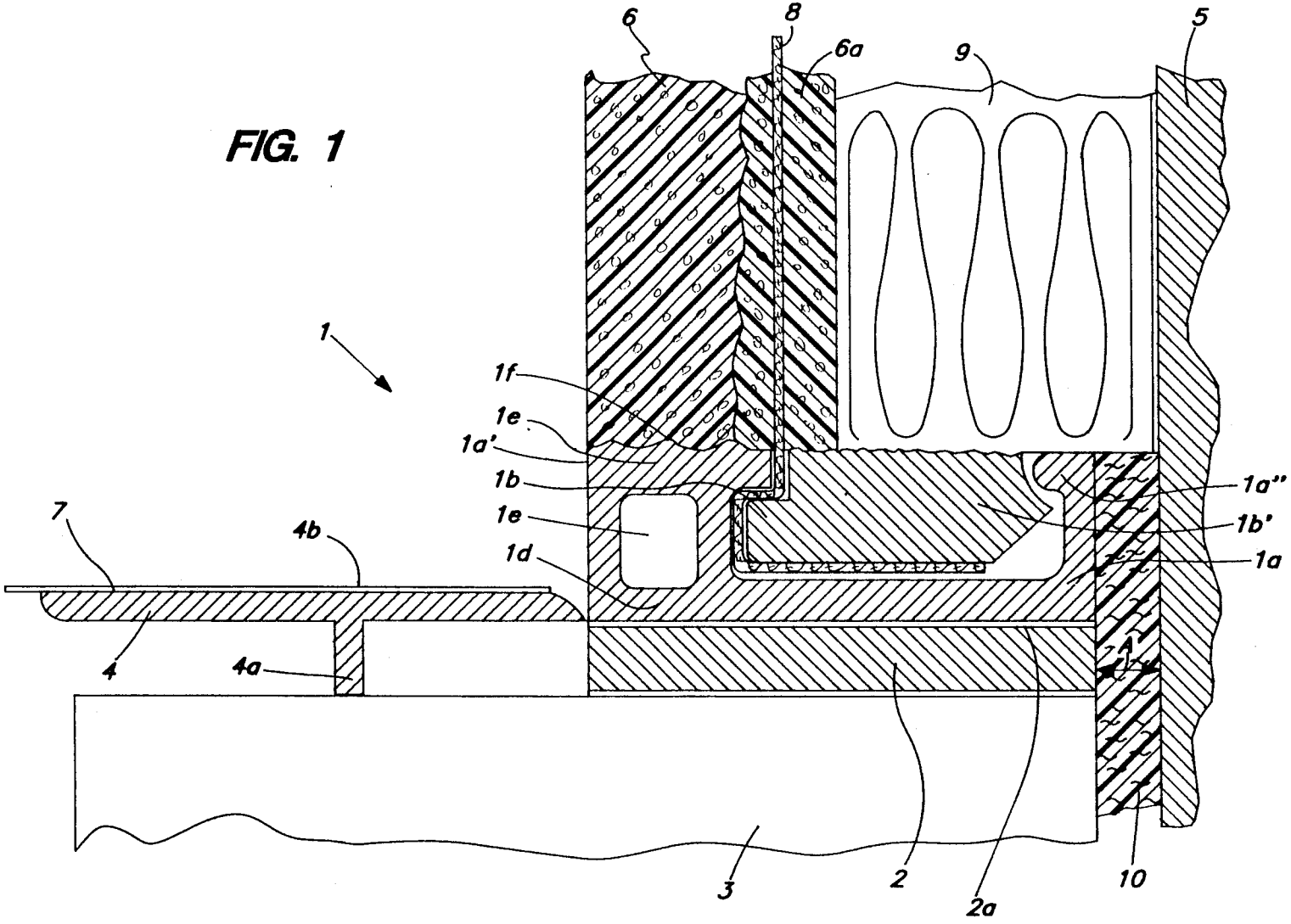

The invention relates to a protective lath for making a plaster joint to a building component of different material when plastering a wall. Such a building component consists, for instance, of wood, plastics or metal. This building component preferably is a window frame, door frame or a rafter end.

Traditionally the wall plaster was applied directly up to the building component, which lead to considerable soiling of the building component and did not result in a durable and tight connection between the wall plaster and the building component.

DE-A-82 25 357 reveals a protective lath of metal, which is adhered to the building component. The protective lath has the edge of a reinforcing fabric adhered thereto which is embedded in the plaster layer during wall plastering. In doing so the top plaster is applied, as before, across the metal rail and the adhesive strip located therebeneath and directly up to the building component, whereby no fixed connection to the building component is created in this portion. The problem known in practical applications, namely the so-called tearing effect, is thus not solved, since the vibrations emanating from such building components are transmitted directly to the top plaster. Furthermore, the reinforcing fabric used there is extended laterally outwardly from the connection between the metal rail and the adhesive strip so that the embedding thereof in the primer layer, which is of different thickness depending on the manufacturers' specifications, cannot be carried out with sufficient variability. Moreover, there is no protection against soiling or damaging of the building component.

German Utility Model 86 11 867 discloses a protective lath of plastics material which, due to its configuration and width, provides protection against soiling or damaging of the building component. However, this protective lath does not have a reinforcing fabric.

Subject matter of the invention is a protective lath for making a plaster joint to a building component of different material, in particular to a window or door frame, comprising the following features:

a) the protective lath has a bottom part of plastics material and a top part of plastics material;
b) the bottom part is provided with an adhesive strip for adhering to the building component;
c) a reinforcing fabric is clamped between bottom and top parts for being embedded in the adjoining plaster;
d) the bottom part is resiliently latched to the top part in positive engagement;
e) the protective lath has a lateral protective tab for protecting the building component, which can be broken off by hand via a notch-type incision.

With the protective lath according to the invention any contact of plaster materials with the other building component is prevented. The vibrations originating from this building component are definitely kept away from the plaster coat and cannot be transmitted thereto. Upon conclusion of the wall plastering operation, the synthetic resin of the protective lath, which is the sole material still visible then, constitutes the alignment edge which is a neat limitation of the jamb plaster and renders possible easy and better care of the window or door frames later on as well.

The protective lath according to the invention can be employed in especially advantageous manner when the wall adjoining the building component is provided with a mineral or organic full thermal insulation system. In such systems the reinforcing fabric often is desirable in order to ensure anchoring of the plaster layer on the thermal insulation layer. In the region of the joint of the plaster layer to the other building component, an ingress of humidity is impossible. The bottom and top parts of the protective lath are preferably made of hard synthetic resin injected by an extruder into a continuous flow mold. The protective tab preferably is of T-shaped cross-section. The reinforcing fabric preferably consists of silk glass coated with synthetic resin. The protective tab, on the side facing away from the building component, preferably has an adhesive tape provided thereon so that a protective film for the window opening or for the door opening may be adhered there. The reinforcing fabric has the effect that the plaster neither in its interior nor towards the protective lath forms cracks and becomes leaky during shrinkage.

Claim 2 describes a first embodiment in which the latching location is located adjacent the walling and the other end of the top part, which also consists of hard synthetic resin, engages an undercut side wall of the bottom part with the reinforcing fabric being interposed therebetween.

In accordance with claim 3 the surfaces of the top and bottom parts adjacent the plaster layer are at least approximately aligned with each other in the pressed-on and latched condition. For facilitating latching, claim 4 provides that the nose piece is rounded in approximately semicircular manner and the associated end of the top part is cut in corresponding manner at its top.

Claim 5 describes a second embodiment according to which the top part merges with the bottom part of approximately the same wall thickness, said top part being folded over at a connecting piece of reduced wall thickness and being pressed on with the reinforcing fabric interposed therebetween, and having its free end resiliently latched in the undercut nose piece of the side wall distal from the walling.

Claims 6 and 7 indicate for both embodiments in what way the top part is advantageously pressed on the bottom part with the reinforcing fabric interposed therebetween.

The fiber plate indicated in claim 8, which in accordance with claim 9 is embedded in a primer layer together with the projecting part of the reinforcing fabric, has the function of a thermal insulation.

Specific types of plaster, in particular plasters of mineral type, necessitate a wide supporting area on the side wall distal from the walling; for saving expensive synthetic resin material and thus also for sparing use of raw materials, an inner cavity is provided in accordance with claim 10.

In accordance with claim 11 the outer side of the side wall distal from the walling serves in known manner as an alignment edge for the top plaster; this outer side at the same time serves as a limit protection when the window or door frames are cleaned.

According to claim 12 the front side of the outer wall distal from the walling is to be provided with elevations of triangular configuration. This outer wall is exposed to weathering and has the plaster adjoining on the front side thereof. By means of the elevations of triangular configuration, a toothed engagement with the plaster is created.

In accordance with claim 13 the protective tab is to carry an inwardly directed web of a height corresponding to the thickness of the soft adhesive strip so that the protective lath and the protective tab are located in one plane when the protective film is applied.

The features indicated in claims 14 to 16 in relation to the soft strip serving for securing the protective lath are intended to provide protection against loosening of the lath from the plaster due to the permanently occurring vibrations.

Figure 2:
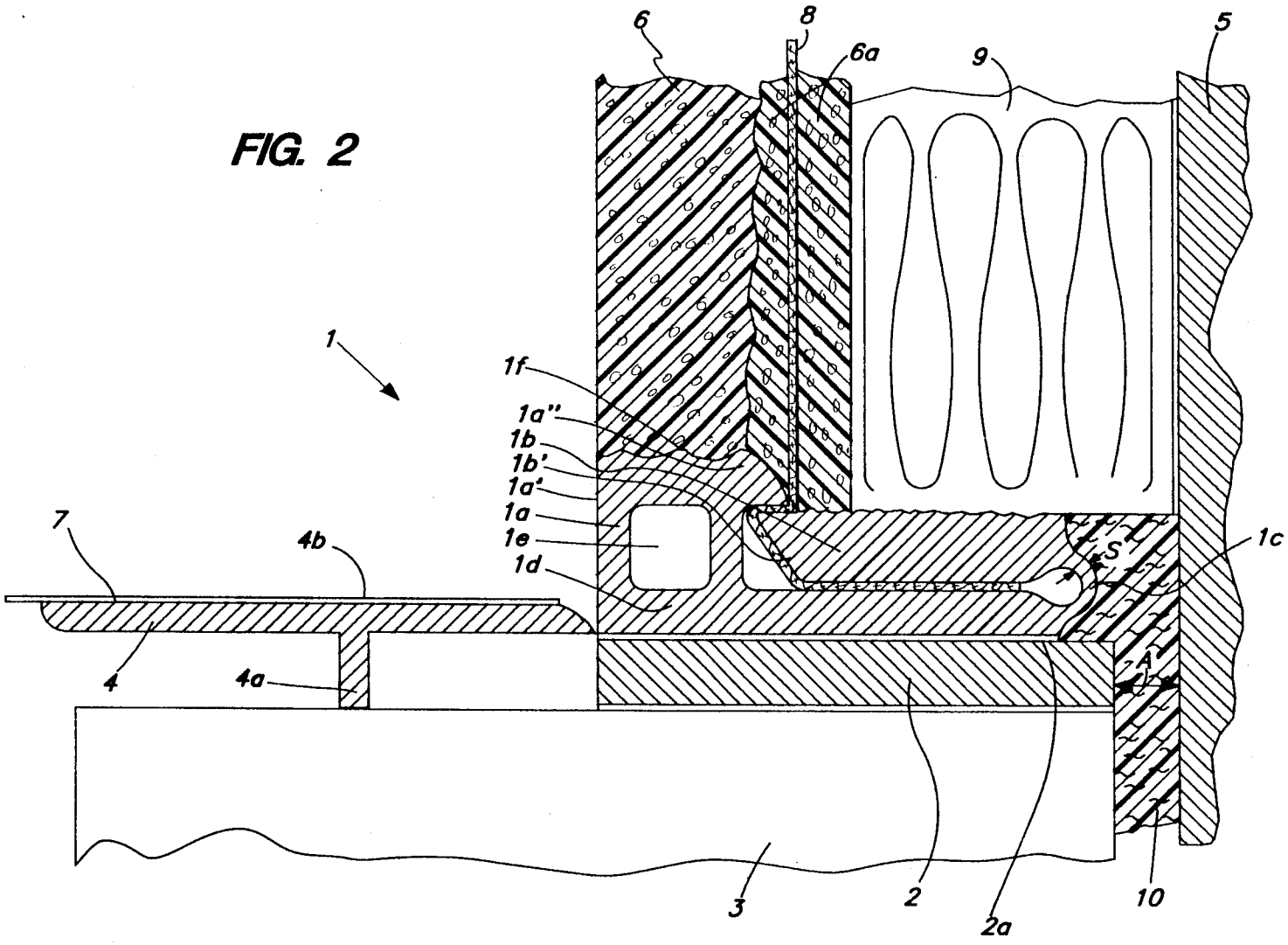
Figure 2A:
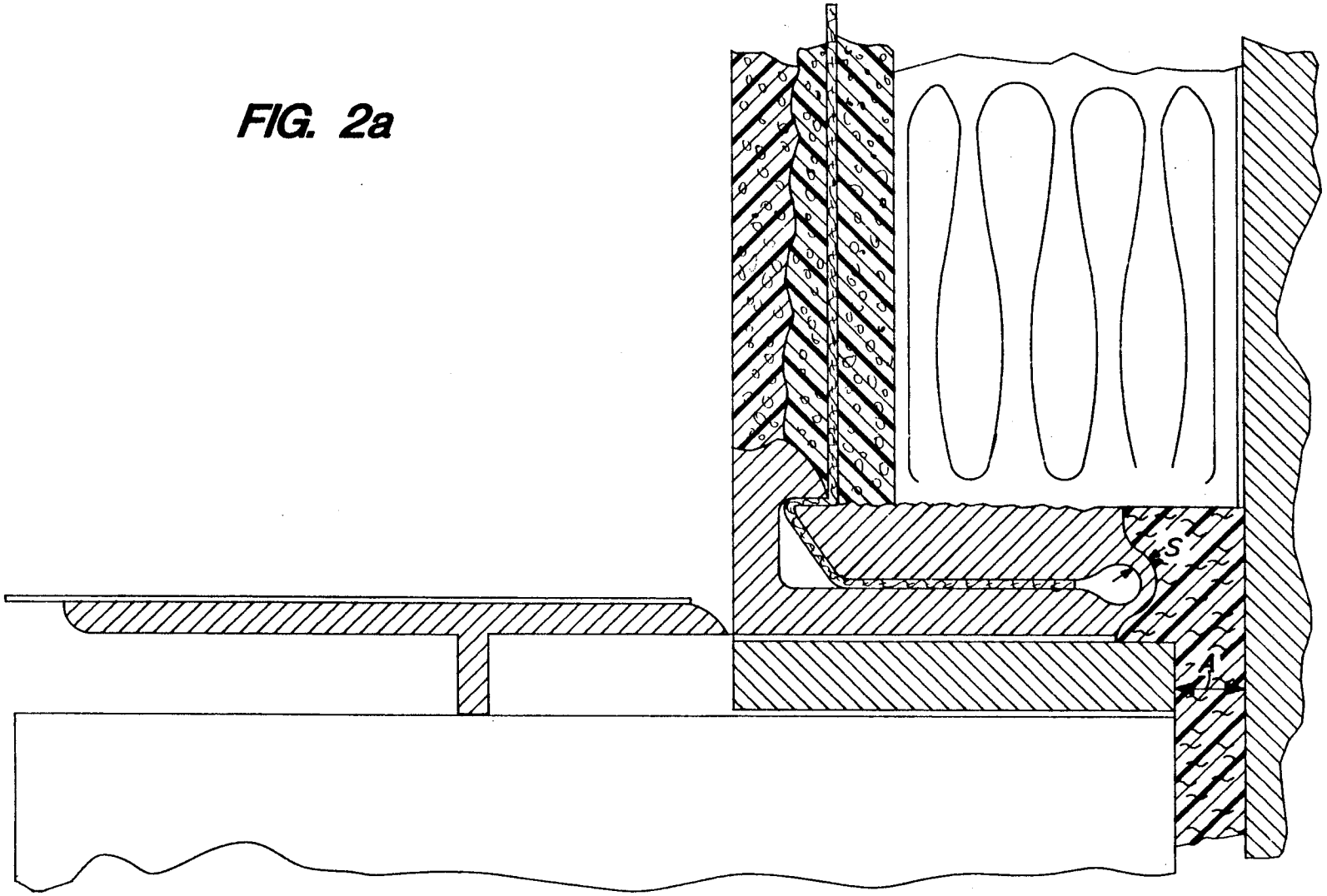

The invention will now be elucidated in more detail by way of two embodiments with reference to a cross-sectional drawing in which FIG. 1 shows the arrangement to be protected, with the top part being pressed into the bottom part, FIG. 2 shows the top part folded over the bottom part, with a broad supporting area being provided for the fiber plate and the plaster each, this view also showing the inner cavity in this part, FIG. 2*a* shows the arrangement with a narrow supporting area for the plaster and without the inner cavity.

According to FIG. 1 a protective lath (1) of hard synthetic resin is secured by means of a strip (2) of equal width and length, having on both sides an adhesive layer (2*a*) of foamed, i.e. soft synthetic resin, to a window or door frame (3) and supported together therewith in the walling (5) with a lateral spacing A that is filled with contact foam or insulating wool (10). Sealing density of the wall plaster against humidity from the outside is achieved in that the bottom part (1*d*) of the protective lath (1), which carries said adhesive strip, has a top part (1*b*) pressed thereon with a reinforcing fabric (8) of synthetic resin coated silk glass being interposed therebetween and extending as far as into the plaster layer (6, 6*a*); the top part (1*b*) also consists of hard synthetic resin and has one end (1*b*') resiliently latched or snapped into an undercut nose piece (1*a*'') of semicircular configuration on the side wall (1*a*) of the bottom part (1*d*)adjacent the walling. The other end (1'') of the top part engages in an undercut side wall (1*c*) of the bottom part with the reinforcing fabric being interposed therebetween and extending from there into the plaster layer. In this pressed-on and latched condition, the surfaces of top and bottom parts (1*b*, 1*d*) adjacent the plaster layer are aligned with each other. The latched end of the top part (1*b*') is rounded at its top in accordance with the semicircular nose piece (1*a*'') and is slanted towards the inside.

The surface of the top part (1*b*), which is preferably smooth but may also be roughened or corrugated, has a thermally insulating fiber plate (9) abutting thereon which is adhered to the walling (5) and which is embedded in a primer layer (6*a*) together with the projecting part of the reinforcing fabric (8). An inner cavity (1*e*) is provided in the side wall (1*c*) distal from the walling (5), the outer edge (1*a*') thereof serving in known manner as an alignment edge for the top plaster.

The protective lath (1) carries a protective tab (4) which can easily be broken off by hand via a notch-like incision (4*a*) and which extends partly across the width of the window or door frame (3); in addition thereto, the tab carries a web (4*a*) directed towards said frame and having a height corresponding to the thickness of the adhesive strip (2). Due to the web (4*a*) the protective tab (4) extends parallel to the building component (3) located underneath, so that it has the same height level as the protective lath (1) located on the opposite jamb side and the protective film (7) to be pressed onto the adhesive tape (4*b*) is located in one plane above the building components (3).

Upon conclusion of the wall plastering operation, the protective film (7) is removed, and the protective tab (4) is broken off or pulled off by hand at the notch-like incision (4*a*).

According to FIG. 2 the sealing density of the wall plaster is achieved in that the bottom part (1*d*) of the protective lath (1) carrying said adhesive strip (2) merges with an upper part (1*b*) of approximately the same wall thickness which is folded over at a connecting piece (1*c*) of reduced wall thickness (S) and, with the reinforcing fabric (8) that extends from there into the plaster layer being interposed therebetween, is pressed against said top part and has a free end (1*b*') latched in an undercut nose piece (1*a*'') of the side wall (1*a*) distal from the walling (5). In doing so, the inwardly slanted free end (1*b*') of this top part is pressed past the nose piece that is rounded towards the plaster layer (6, 6*a*).

Here too, the upper surface of the top part (1*b*) has a thermally insulating fiber plate (9) abutting thereon, which is adhered to the walling (5) and is embedded in a primer layer (6*a*) together with the projecting part of the reinforcing fabric (8). An inner cavity (1*e*) is provided in the side wall (1*a*) distal from the walling, the outer side (1*a*) of said side wall serving in known manner as an alignment edge for the top plaster and the front edge thereof, having said elevations (1*f*) of triangular configuration, forming a tooth-like engagement with the plaster.

FIG. 2*a* differs merely in that the supporting area of the side wall (1*a*) for the plaster (6) is so narrow that an inner cavity possibly can be dispensed with.

In FIGS. 2 and 2*a*, the protective tab (4) is formed in like manner as in FIG. 1.

I claim:

1. A protective lath for making a joint between plaster on a walling and a building component of a different material, in particular to a window or door frame, comprising:

a) a bottom part of plastics material and a top part of plastics material;

b) an adhesive strip for adhering the bottom part to the building component;

c) engagement means for resiliently latching said top part to said bottom part;

d) a reinforcing fabric clamped between said bottom and top parts in a position to be embedded in the plaster;

e) a lateral protective tab extending from the bottom part for protecting the building component;

f) a notch-type incision positioned between the bottom part and said lateral protective tab, and sized such that said lateral protective tab can be broken off by hand.

2. A protective lath according to claim 1, wherein the engagement means comprises a latching end of the top part adjacent the walling and another end of the top part which engages an undercut side wall of the bottom part with the reinforcing fabric being interposed therebetween.

3. A protective lath according to claim 2, characterized in that, when latched, surfaces of the top and bottom parts adjacent the plaster are approximately aligned with each other.

4. A protective lath according to claim 2, characterized in that a nose piece on the bottom part is rounded in an approximately semicircular manner at its top and the latching end of the top part is cut in a corresponding manner at its top.

5. A protective lath according to claim 4, characterized in that the latching end of the top part is slanted towards the inside.

6. A protective lath according to claim 1, characterized in that said top part is connected to a portion of said bottom part of approximately the same thickness by a connecting piece of reduced thickness and has its free end resiliently latched in an undercut nose piece of a side wall distal from the walling with the reinforcing fabric interposed therebetween.

7. A protective lath according to claim 6, characterized in that the nose piece is rounded in the direction towards the plaster.

8. A protective lath according to claim 7, characterized in that the free end of the top part is slanted towards the inside.

9. A protective lath according to claim 1, characterized in that a fiber plate adhered to the walling abuts an optionally roughened or corrugated top part.

10. A protective lath according to claim 9, characterized in that the fiber plate is embedded in a primer layer of plaster together with part of the reinforcing fabric.

11. A protective lath according to claim 1, characterized in that a side wall of the bottom part distal from the walling has an inner cavity.

12. A protective lath according to claim 1, characterized in that an outer side of a side wall of the bottom part distal from the walling serves as an alignment edge for the plaster.

13. A protective lath according to claim 1, characterized in that a front side of the side wall of the bottom part distal from the walling is provided with elevations of triangular configuration.

14. A protective lath according to claim 1, characterized in that the protective tab carries a web which faces towards said building component and which has a height corresponding to the thickness of the adhesive strip; and, a side opposite to the web carries an adhesive tape to which a protective film is attached.

15. A protective lath according to claim 1 characterized in that the adhesive strip consists of a foamed, soft synthetic resin and carries an adhesive layer on both sides thereof.

16. A protective lath according to claim 15, characterized in that the adhesive strip is formed with a thickness of 0.8 to 8 mm.

17. A protective lath according to claim 1, characterized in that the adhesive strip extends across the entire length and width of said lath.

* * * * *